US008333021B2

(12) United States Patent
Johnson

(10) Patent No.: US 8,333,021 B2
(45) Date of Patent: Dec. 18, 2012

(54) ARTICLE OF FOOTWEAR WITH A COLLAPSIBLE STRUCTURE

(75) Inventor: Jeffrey L. Johnson, Taichung (TW)

(73) Assignee: NIKE, Inc., Beaverton, OR (US)

( * ) Notice: Subject to any disclaimer, the term of this patent is extended or adjusted under 35 U.S.C. 154(b) by 518 days.

(21) Appl. No.: 12/493,060

(22) Filed: Jun. 26, 2009

(65) Prior Publication Data

US 2010/0325918 A1 Dec. 30, 2010

(51) Int. Cl.
*A43B 3/14* (2006.01)
*A43B 7/06* (2006.01)

(52) U.S. Cl. ..... 36/11; 36/9 R; 36/3 A; 36/7.1 R

(58) Field of Classification Search ..... 36/11, 9 R, 36/3 A, 7.1 R; D2/924
See application file for complete search history.

(56) References Cited

U.S. PATENT DOCUMENTS

| | | | | | |
|---|---|---|---|---|---|
| 1,980,486 | A | * | 11/1934 | King et al. | 36/8.1 |
| D147,628 | S | * | 10/1947 | Walsh | D2/924 |
| 2,541,020 | A | * | 2/1951 | Arnold | 12/142 G |
| D169,956 | S | * | 7/1953 | Baroumes | D2/924 |
| 2,679,117 | A | | 5/1954 | Reed | |
| 2,697,117 | A | * | 12/1954 | Cole et al. | 562/98 |
| 3,605,291 | A | * | 9/1971 | Moore | 36/7.1 R |
| D244,727 | S | * | 6/1977 | Borri | D2/924 |
| 4,145,822 | A | * | 3/1979 | Mitchell et al. | 36/87 |
| 4,265,032 | A | | 5/1981 | Levine | |
| 5,012,541 | A | * | 5/1991 | Ganon | 12/142 G |
| 7,171,767 | B2 | * | 2/2007 | Hatfield et al. | 36/97 |

FOREIGN PATENT DOCUMENTS

| | | |
|---|---|---|
| FR | 2 744 342 | 8/1997 |
| FR | 2 904 919 | 2/2008 |
| JP | 51-004528 | 1/1976 |
| JP | 5228001 | 9/1993 |
| WO | 93/19630 | 10/1993 |

OTHER PUBLICATIONS

International Preliminary Report on Patentability issued in corresponding International Application No. PCT/US2010/038922, dated Jan. 4, 2012.
International Search Report and Written Opinion in corresponding PCT/US2010/038922 mailed Oct. 21, 2010.

* cited by examiner

*Primary Examiner* — Ted Kavanaugh
(74) *Attorney, Agent, or Firm* — Banner & Witcoff, Ltd.

(57) ABSTRACT

An article of footwear with a sole and a collapsible upper attached to sole. The collapsible upper includes a first portion and a second portion which is below the first portion and extends from the sole to the first portion. Further, the collapsible upper also includes a seam which is positioned above the sole and is not in contact the sole. The seam joins substantially the entire perimeter of the first portion with substantially the perimeter of the second portion. Additionally, when the upper is in a collapsed state, the seam becomes the widest points of the article of footwear and defines the perimeter of the article of footwear.

19 Claims, 18 Drawing Sheets

ARTICLE OF FOOTWEAR WITH A COLLAPSIBLE STRUCTURE

FIELD OF THE DISCLOSURE

Aspects of the present disclosure generally relate to footwear, and more particularly to footwear which includes a collapsible structure.

BACKGROUND

Conventional footwear typically has two primary portions, namely an upper and a sole. The upper provides a covering for the foot that receives and positions the foot with respect to the sole. The sole structure generally is secured to a lower portion of the upper member and generally is positioned between the foot and the ground. The sole may provide traction and cushioning. Accordingly, the upper and the sole operate cooperatively to provide a structure that is suited for a variety of ambulatory activities, such as walking. The production of such conventional footwear (from manufacturing through delivery to the end user) requires the expenditure of materials, energy, financial resources and also has an impact on the environment.

For example, the shipping of conventional footwear (e.g., from the manufacturing site to a vendor for sale) has an associated expense/cost and, also, has a potentially negative impact on the environment. Conventional footwear has an upper that extends upwards vertically from the sole to define a height and also a volume which occupies a predetermined amount of space. Further, in order to prevent damage to the footwear during shipping, conventional footwear is usually shipped in a shoebox which surrounds and protects the footwear, but occupies additional space. The volume of each article of footwear in its shoebox limits the total amount of footwear that can be transported in a finite amount of space (e.g. the trailer of a truck used for shipping the footwear). This spatial limitation requires more total loads of footwear to be shipped and, therefore, increases the cost of shipping. For example, costs associated with shipping the footwear, such as fuel for the shipping means (e.g., trucks) will be increased due to an increase in the amount of loads. Similarly, the spatial limitation will increase the potential negative impact on the environment because the increase in the number of loads will increase the amount of energy expended due to shipping. For example, the exhaust gases produced by the shipping means (e.g., trucks), can damage the environment (e.g., reducing air quality, damaging the ozone layer, etc.) and an increase in the amount of loads will increase the amount of damage to the environment. Hence, it would be desirable to reduce the amount of volume that an article of footwear occupies during shipping.

The manufacturing of conventional footwear also requires an expenditure of financial resources and energy. For example, conventional footwear may require orienting, assembling and securing different pieces or layers of material by different lines of intricate stitching. Such processes will have associated financial costs and energy expenditures. Further, the more complicated the conventional footwear and the more difficult the footwear is to assemble, the more financial resources and energy will have to be expended to manufacture the footwear. The energy expenditure associated with such manufacturing tasks can have a potentially negative environmental impact. For example, machinery may be used to perform the intricate assembly and stitching of the conventional footwear. The longer the machinery is operated (as it would be for more intricate and prolonged assembly), the greater amount of power the machinery will draw and, thereby, consume more environmental resources. Therefore, it would be desirable to reduce the amount of energy required for manufacturing a particular footwear product and, thereby, reduce the financial costs and potentially negative environmental impact associated with the manufacturing of a particular footwear product.

Similarly, it is realized that the more material (e.g., pieces or layers of material) that is included in an article of footwear, the greater the expense of producing the article of footwear will be and also greater the potential negative environmental impact will be. For example, generally, incorporating more material into an article of footwear will require more assembly and manufacturing. As described above, the increasing the amount of manufacturing required for an article of footwear will resultantly increase both the financial cost and the potential negative impact on the environment associated with manufacturing of the article of footwear. Hence, it would be desirable to reduce the amount of material used in an article of footwear.

Therefore, as the cost of both energy and materials continue to rise, the financial incentive to limit their use as much as possible increases. Further, limiting the amount of both materials and energy used during the production of footwear (from manufacturing through delivery to the end user) has a beneficial effect on the environment. Therefore, it would be desirable to produce footwear which reduces the amount of materials and energy consumed during the manufacturing and shipping of such footwear. Such footwear can result in financial savings for the manufacturer and also reduces the potentially negative environmental impact associated with the manufacturing the footwear.

SUMMARY

The following presents a general summary of aspects of the disclosure in order to provide a basic understanding of at least some of its aspects. This summary is not intended as an extensive overview of the disclosure. It is not intended to identify key or critical elements of the disclosure or to delineate the scope of the disclosure. The following summary merely presents some concepts of the disclosure in a general form as a prelude to the more detailed description provided below.

Aspects of this disclosure relate to footwear that minimizes the expenditure of materials, energy and financial resources during production (i.e. from manufacturing through delivery to the end user). More particularly, aspects of the invention relate to collapsible footwear structures.

The collapsible nature of the footwear structures according to the present disclosure can reduce the financial expenses and energy consumption associated with shipping the footwear. For example, in contrast to the large spatial limitation that conventional footwear requires (as described above), the collapsible footwear according to the aspects of this invention, substantially reduces the amount of volume that the article of footwear occupies. Since the inventive footwear can be shipped in a collapsed state, a greater number of articles of footwear can be transported within the same finite space (e.g. the trailer of the above mentioned truck used for shipping the footwear). Hence, more footwear is transported for the same amount of financial expense and energy consumed. This results in a significant financial savings for the manufacturer of the footwear (e.g. fuel for the trucks shipping the footwear is reduced per the amount of footwear shipped). Similarly, the reduction in the amount of energy consumed during shipping creates a substantial beneficial for the environment (e.g. the exhaust gases produced the by the shipping means, such as trucks is reduced per the amount of footwear shipped).

Further, aspects of this collapsible footwear according to the present invention relate to the footwear including only a relatively minimal amount of materials to manufacture compared with conventional footwear. For example, in contrast to the uppers of conventional footwear that may include different pieces or layers, different materials, etc., aspects of this disclosure are directed to footwear which may include primarily two flat planes of material (and, in some embodiments, an additional sole structure). This reduction in the amount of materials used, limits the costs of the raw and processed materials used in manufacturing the footwear. Therefore, such footwear can result in financial savings for the manufacturer and also reduce the environmental impact associated with the manufacturing the footwear.

Additional aspects of this disclosure relate to the construction of such collapsible footwear structures. Footwear according to this disclosure may be manufactured in a collapsed, or flat, state. For example, footwear according to aspects of the invention may be manufactured primarily by joining two flat planes of material and forming slits therein. Further, the two flat planes of material may be joined by a single line of stitching around the periphery of the two flat planes. Being able to manufacturing the footwear in such a manner reduces the time and energy associated with construction of the footwear. For example, in contrast to conventional footwear which may require considerable time and energy to construct (e.g. time and energy spent securing different pieces or layers by way of different lines of stitching, time and energy spent vertically orienting different pieces of the material, etc.), footwear according to aspects of the invention may be constructed in less time and with less energy expended during the manufacturing process. Hence, footwear according to aspects of this disclosure reduces the environmental impact associated with the manufacturing the footwear. Further, the decreased time and energy required to manufacture the footwear can result in financial savings for the manufacturer.

Additional aspects of this disclosure relate to footwear structures which are collapsible. For example, aspects of this disclosure relate to an article of footwear with a sole and a collapsible upper attached to sole. The collapsible upper includes a first portion and a second portion which is below the first portion and extends from the sole to the first portion. Further, the collapsible upper also includes a seam which is positioned above the sole and also is not in contact the sole. The seam joins substantially the entire perimeter of the first portion with substantially the perimeter of the second portion. Additionally, when the upper is in a collapsed state, the seam becomes the widest points of the article of footwear and defines the perimeter of the article of footwear.

Additional aspects of this disclosure relate to an article of footwear with a collapsible upper. The collapsible upper includes a first portion and a second portion. Further, the second portion includes a central portion that defines a footbed which contacts and supports the sole portion of a user's foot when the foot is inserted into the article of footwear. The collapsible upper also includes a seam, above the footbed, which joins the first portion and the second portion. When the collapsible upper is in a collapsed state, the seam defines the article of footwear's widest point and, further, the seam extends around the perimeter of the article to as to encircle the footbed.

Additional aspects of this disclosure relate to an article of footwear with a sole and a collapsible upper. The collapsible upper includes a first portion and a second portion, which is below the first portion and, further, extends from the sole to the first portion. The collapsible upper also includes a seam which is positioned above the sole, is not in contact the sole, and further joins at least a portion of the perimeter of the first portion with at least a portion of the perimeter of the second portion. Additionally, when the upper is in a collapsed state, the seam becomes the widest points of the article of footwear and defines at least a portion of the perimeter of the article of footwear.

BRIEF DESCRIPTION OF THE DRAWINGS

A more complete understanding of the present disclosure and certain advantages thereof may be acquired by referring to the following description in consideration with the accompanying drawings, in which like reference numbers indicate like features, and wherein.

DETAILED DESCRIPTION

In the following description of various example embodiments of the disclosure, reference is made to the accompanying drawings, which form a part hereof, and in which are shown by way of illustration various example structures, systems, and steps in which aspects of the disclosure may be practiced. It is to be understood that other specific arrangements of parts, structures, example devices, systems, and steps may be utilized and structural and functional modifications may be made without departing from the scope of the present disclosure. Also, while the terms "top," "bottom," "front," "back," "side," and the like may be used in this specification to describe various example features and elements of the disclosure, these terms are used herein as a matter of convenience, e.g., based on the example orientations shown in the figures. Nothing in this specification should be construed as requiring a specific three dimensional orientation of structures in order to fall within the scope of this disclosure.

Figure 1:
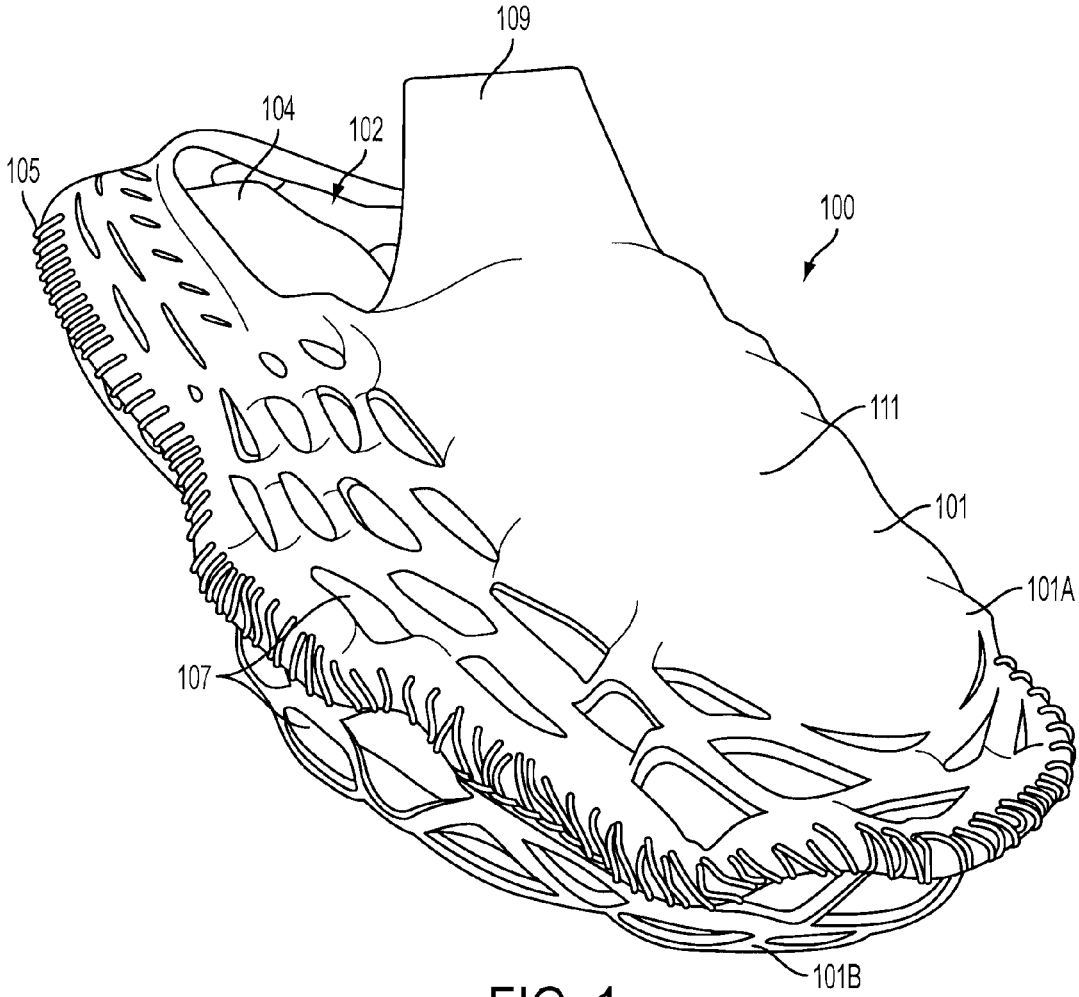
FIG. 1 illustrates a perspective view of an article of footwear according to at least some aspects of the disclosure with the article of footwear shown in a simulated use state.
Figure 2:
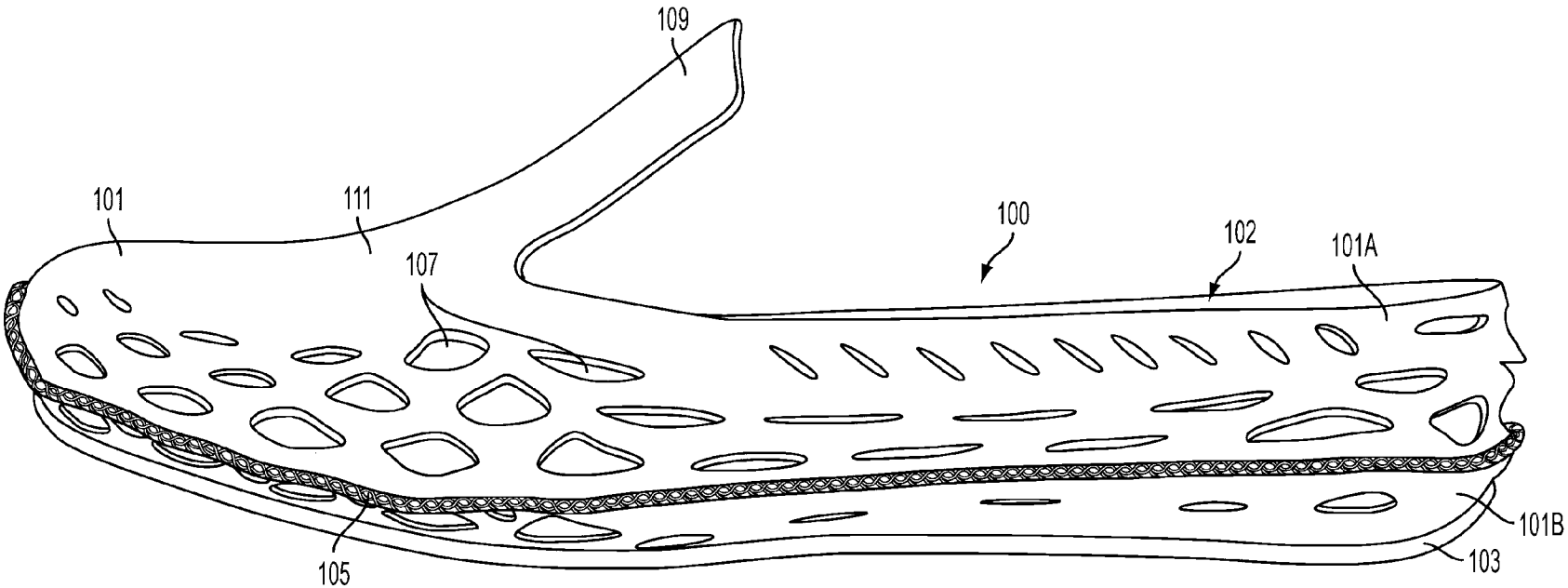
FIG. 2 illustrates a medial side view of the article of footwear shown in FIG. 1.
Figure 3:
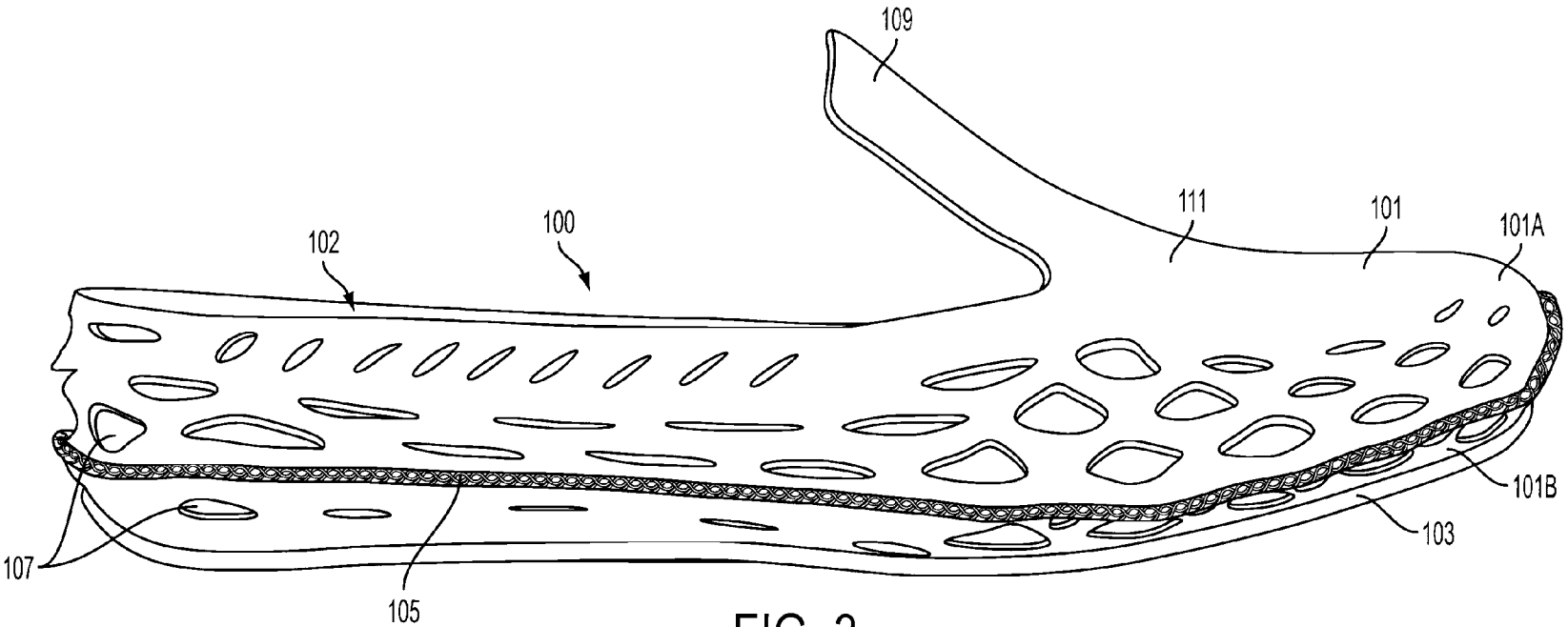
FIG. 3 illustrates a lateral side view of the article of footwear shown in FIG. 1.
Figure 4:
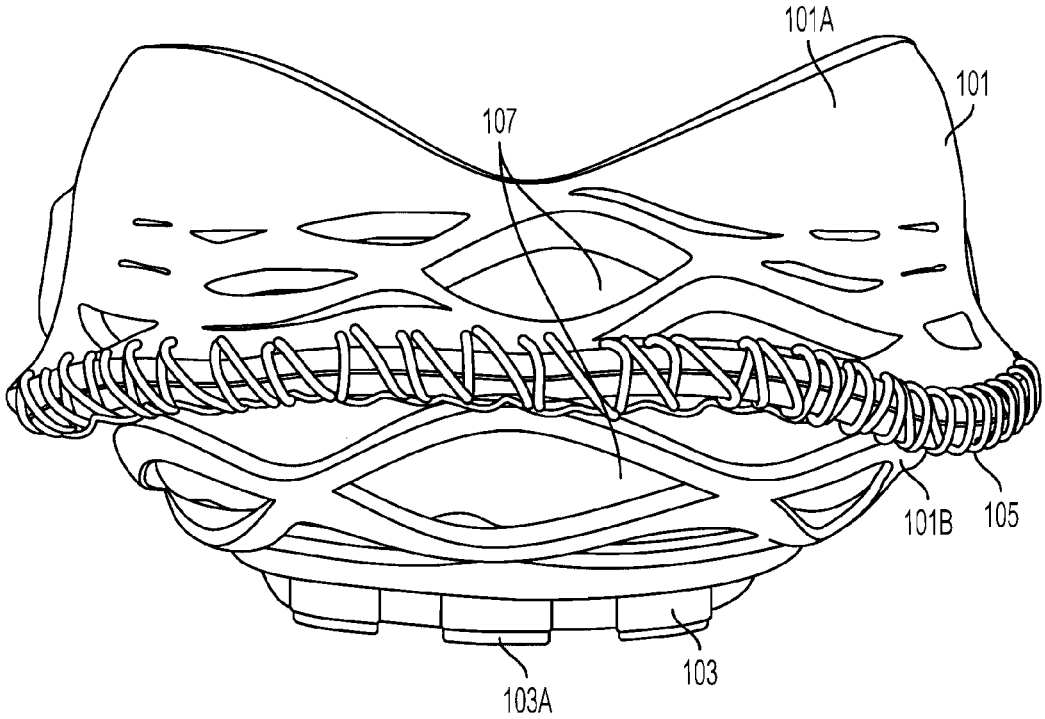
FIG. 4 illustrates a rear view of the article of footwear shown in FIG. 1.
Figure 5:
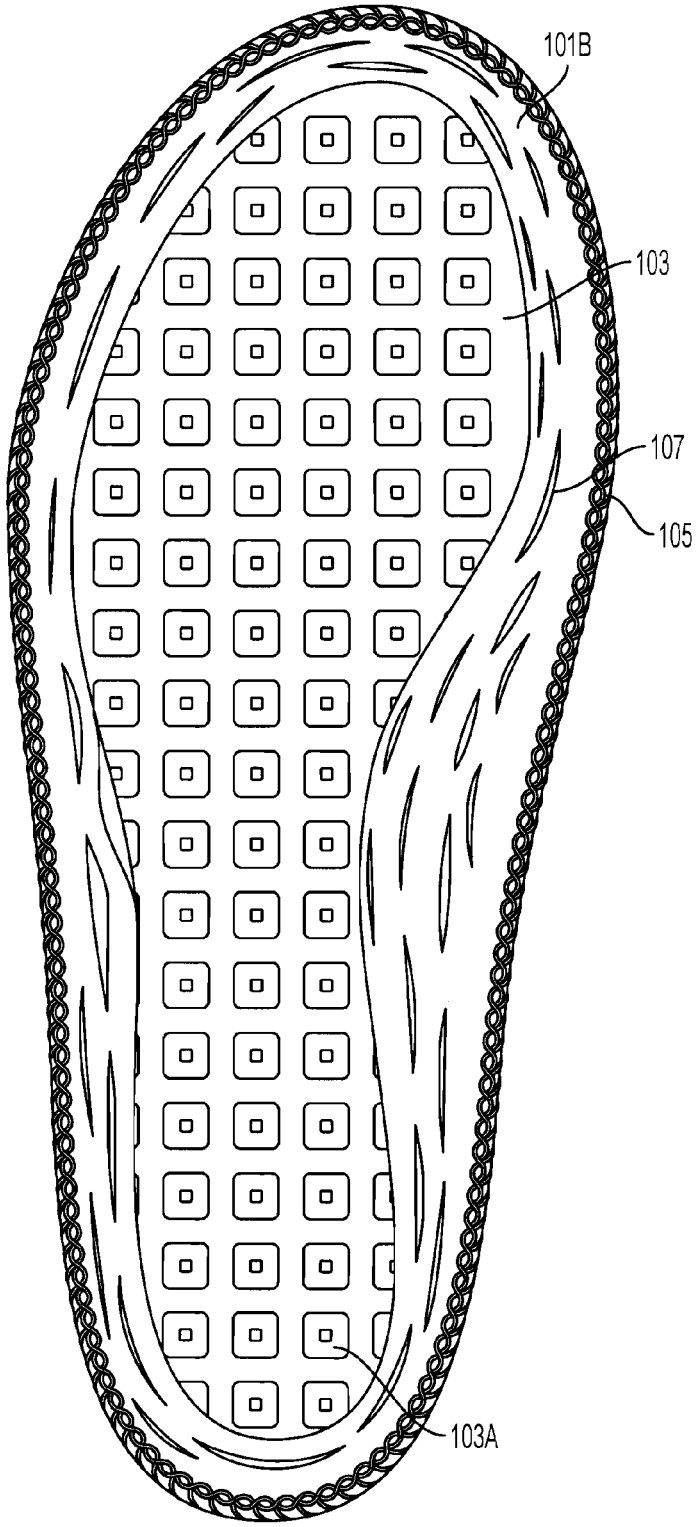
FIG. 5 illustrates a bottom view of the article of footwear shown in FIG. 1 when the article of footwear is in a collapsed state.

FIGS. 1-7 show a various views of an illustrative embodiment of an article of footwear 100 according to at least some aspects of this disclosure. The article of footwear 100 has a collapsible upper 101. As shown in FIGS. 1-4, the collapsible upper 101 includes a first portion 101A, a second portion 101B and an opening 102. As seen in FIG. 5, the article of footwear may include a sole structure 103. In such embodiments, the sole structure 103 is attached to the upper 101. For example, as seen in FIGS. 2-3, the illustrative embodiment includes such a sole structure 103 attached to the second portion 100B of the upper 101. Therefore, as seen in the depicted illustrative embodiment, according to at least some aspects of this disclosure, the second portion 101B may be positioned below the first portion 101A. Further, as seen in FIG. 1, the second portion 101B may include a central portion that acts as a footbed 104. In other words, the upper surface of the second portion 101B will contact and support the sole of the foot.

Figure 6:
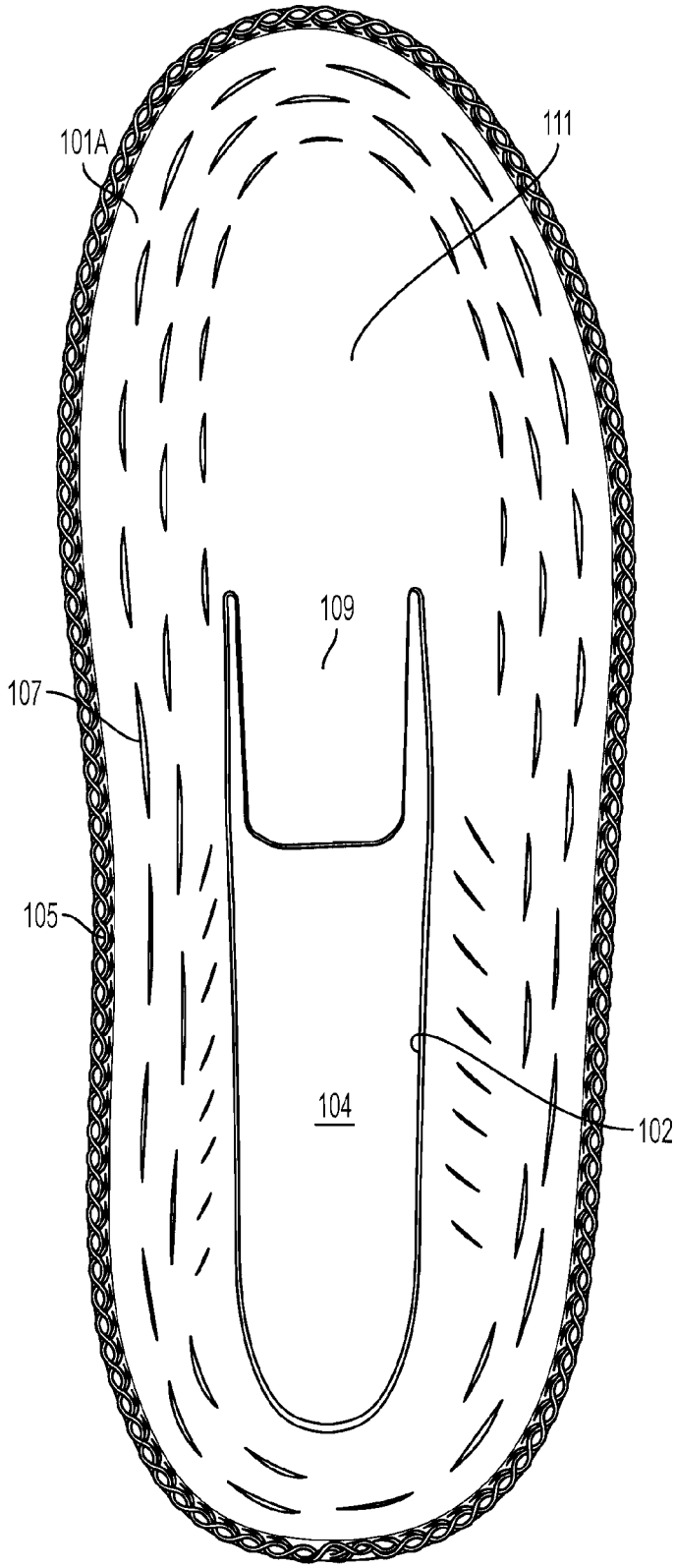
FIG. 6 illustrates a top view of the article of footwear shown in FIG. 1 when the article of footwear is in a collapsed state.
Figure 7:
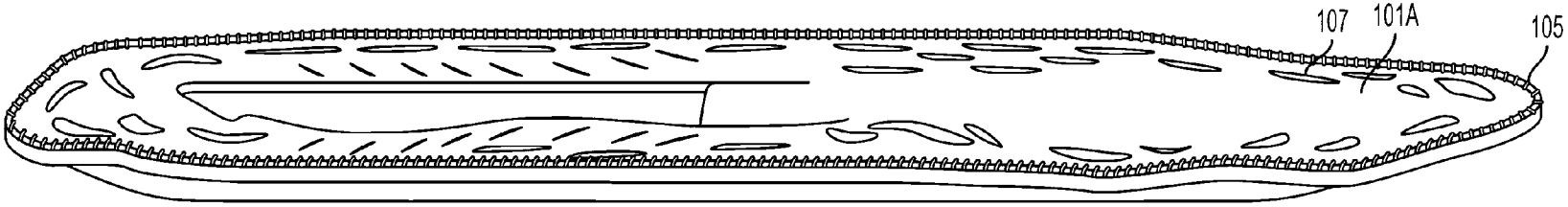
FIG. 7 illustrates a side perspective view of the article of footwear shown in FIG. 1 when the article of footwear is in a collapsed state.

The article of footwear 100 can fold flat so that when the article of footwear 100 is in the folded (i.e. collapsed state), it is relatively thin. For example, the collapsible upper 101 can collapse in such a way that the first portion 101A lays flat on top the second portion 101B. FIGS. 5-7 show the article of footwear 100 in such as collapsed state. As seen, in the collapsed state, the thickness of the article of footwear 100 is substantially the combined thickness of: the first portion 101, the second portion 100B and the sole 103. Each of the first and second portions 101A and B may be comprised of a cutout from a single sheet of material. Therefore, when the article of footwear 100 is in the collapsed state, the thickness of the upper 101 is merely substantially the thickness of the two sheets of the material (i.e., first and second portions 101A and B). Hence, the thickness of the entire article of footwear 100 is merely substantially the thickness of the two sheets of the material and the sole 103.

The first and second portions 101A and B are joined together by a seam 105. Therefore, according to at least some embodiments, in a use state, as seen in FIGS. 1-4, the first portion 101A extends upwards from the seam 105, while the second portion 101B extends between the sole portion 103 and the seam 105. Further, as shown in FIGS. 5-6, in the collapsed state, the first portion 101A and second portion 101B may have generally matching shapes and perimeters. Additionally, in such a collapsed state, the areas the first portion 101A and second portion 101B are generally similar (except for, of course, the opening 102 in the first portion for inserting and withdrawing the foot).

As shown in the illustrative embodiment, a seam 105 joins the first portion 101A and second portion 101B of the upper 101. The seam 105 may be positioned so that it joins at least a portion of the perimeter of the first portion 101A with at least a portion of the perimeter of the second portion 101B. According to at least some embodiments, the seam 105 joins substantially the entire perimeter of the first portion 101A with substantially the entire perimeter of the second portion 101B so that the seam 105 extends substantially around the entire perimeter of the upper 101.

For example, as seen in the illustrative embodiment shown in FIGS. 1-7, the seam 105 joins the perimeter of the first portion 101A with the perimeter of the second portion 100B and, therefore, the seam 105 extends around the perimeter of the upper 101. Therefore, as shown in FIGS. 5 and 6, when the article of footwear is in collapsed state, the seam 105 becomes the widest points of the footwear 100. In fact, the seam 105 becomes the perimeter of the footwear 100. Therefore, the seam 105 is completely outside of (and surrounds) the sole structure 103. Conversely, when the article of footwear 100 is in the expanded state (i.e., the use state), the vertical location of the seam 105 will depend on the size and dimensions of the first and second portions 101A and B. For example, as shown in FIGS. 2-3, the seam 105 may be positioned between the first portion 101A and the second portion 101B with regard to a vertical direction along the lateral and medial sides of the footwear 100.

As discussed above, according to some aspects of the invention, the second portion 101B may include a central portion which acts as a footbed 104 to contact and support the sole of the foot. In such an embodiment, the bottom of the central portion of the second portion 101B may be adhesively bonded to the sole 103. However, in an alternative embodiment, the second portion 101B does not have a central portion. Instead, the second portion of the upper 101B, is attached to the sole 103 at the perimeter of the sole 103 (with conventional methods such as stitching, adhesive bonding, etc.), but will not cover the center portion of sole 103. Hence, in this embodiment, the top of the sole 103 will be in direct contact with the foot. In other words, the sole 103 will act as the footbed 104 to contact and support the sole of the foot.

Therefore, as discussed above, it will be understood that in at least some embodiments of the disclosure, the article of footwear 100 may be comprised essentially of three elements: a first portion of the upper, a second portion of the upper and a sole (this is exclusive of stitching, a bonding material between the sole and the upper, etc.). Although it is noted that according to some embodiments, the article of footwear 100 may include a supplemental liner. For example, in the embodiment discussed above, wherein the second portion of the upper 101B does not include a central portion, the supplemental liner may be provided to cover the sole 103 and act as the footbed 104. In other words, the supplemental liner will be in direct contact with the foot and provide support for the sole of the foot.

It is noted that according to some embodiments the article of footwear 100 may include two or more seams. For example, a first seam may extend along a lateral side of the perimeter of the footwear to join the first portion with the second portion while a second seam may extend along a medial side of the perimeter of the footwear to join the first portion with the second portion. Additional seams may be used at the front and back of the footwear in addition to or in the alternative of the above described lateral and medial side seams. While such embodiments are within the scope of the invention, it is noted that a single continuous seam may reduce manufacturing costs.

Further, it is noted, that while the depicted embodiment illustrates the seam 105 being stitching, other type of seams can also be applicable. For example, conventional methods such as welding, melting, adhesives, etc. may be employed to join the first and second portions 101A and 101B and create the seam 105. However, the seam joining the first and the second portions should be strong and durable enough to withstand the repeated expansion and contraction caused by a user, such as wearing or merely inserting and removing the foot into their footwear.

As discussed in detail below, a configuration that provides a first portion 101A, a second portion 101B and positions a seam 105, in such a manner as described above, enhances the collapsibility of the upper 101. As described above, the first portion 101A of the upper 101 may be a single cutout of a material sheet and the second portion 101B of the upper 101 may be a cutout of a material sheet. Therefore, by positioning the seam 105 at the perimeter of the first and second portions 101 A&B, when the upper 101 is in a collapsed state, the first portion 101A of the upper 101 extends in a first, substantially flat and substantially horizontal plane and the second portion 101B of the upper 101 extends in a second, substantially flat and substantially horizontal plane underneath the first plane. Further, as seen in FIG. 5-7, in a collapsed state, the first portion 101A lies on the second portion 101B so that substantially all of a bottom surface of the first portion 101A is in contact with an upper surface of the second portion 101B. Therefore, the collapsibility of the article of footwear is maximized. Further, the first and second portions 101A and B being "stacked" on each other in such a manner, results in a collapsed state that will occupy a minimum amount of volume. It is noted that while the thickness of the footwear 100 will vary depending on the material used and the dimensions desired, using a single plane of material for each of the first portion 101A and second portion 101B, will contribute to the limiting the thickness of the footwear 100 when it is in the collapsed state, such as shown in FIG. 7. Therefore, using a single plane of material for each of the first portion 101A and second portion 101B aids in reducing the volume the footwear occupies when in the collapsed state (i.e. when the footwear is at its thinnest).

According to some aspects of the disclosure, the thickness of the first portion 101A is less than ⅜ inch and preferably less than ¼ inch or less than ⅛ inch. Also, according to some aspects of the disclosure, the thickness of the second portion 100B is less than ⅜ inch and preferably less than ¼ inch or less than ⅛ inch. Therefore, according to some aspects of the disclosure, when the upper 101 is in a collapsed state, the thickness, or height, of the upper 101 is less than ¾ inch and preferably less than ½ inch or less than ¼ inch. Further, the thickness of the sole may be ¼ inch or less and preferably 3/16 inch or less or ⅛ inch or less. Therefore, the thickness or height of the entire article of footwear 100 may be less than 1 inch and preferably less than ¾ inch or ⅜ inch. Of course, these dimensions are merely examples, and other dimensions could be used depending on the properties desired. Regardless, the above mentioned objective of being able to transport more footwear with less expense and with less energy expended is achieved.

Further, an additional advantage of the above described configuration that includes a first and second portion 101 A&B and positions the seam 105 at the perimeter of the first and second portions, 101A&B, is that such a configuration allows the seam 105 to direct expansion along the contours of the foot. For example, when the upper 101 is in an expanded state, the first portion 101A drafts upwardly and inwardly from the seam 105 towards the center of the article footwear 100 (i.e., in toward the ankle of the user). Conversely, the second portion 101B of the upper drafts downwardly and inwardly from the seam 105 towards the center of the article of footwear 100 when the upper 101 is in the expanded state. This drafting allows the first and second portion to easily conform to the shape of the user's foot.

According to particular embodiments of the disclosure, the upper 101 may include a plurality of slits 107 which allow the upper 101 to expand to accommodate a foot of a user. The slits 107 may be formed in the upper 101 by conventional techniques such as laser cutting, cutting blades, etc. As seen in FIG. 5-7, when the upper 101 is in the collapsed state, the slits are substantially "closed." In other words, there is not much, if any, separation between the opposing sides of the slits 107. This feature of the slits 107 aids the collapsibility of the upper 101 because the lack of separation between the opposing sides of the slits 107 reduces of volume that the upper occupies. However, as shown in FIGS. 1-4, when the user's foot is inserted into the article of footwear 100, the slits 107 will separate and form apertures in the upper 101. For example, as seen in FIGS. 1-4, the expansion of the upper 101 causes the plurality of slits 107 expand and create a web-like structure around the foot of the user. Therefore, the slits 107 can aid in allowing the upper to expand in order to accommodate the user's foot.

As seen in the illustrative embodiment, a plurality of slits 107 are formed each of the first portion 101A and second portion 101B of the upper 101. Further, as best seen in FIGS. 5 and 6, the slits 107 may be formed around the perimeter of each of the first portion 101A the second portion 101B. Positioning the slits 107 at the perimeters of the first and second portions 101A and 101B of the upper, allows for greater expansion vertically along the sides of the user's foot. In the illustrative embodiment, the slits 107 may positioned in a circular ring shaped configuration around the periphery of the footwear. Further, as seen in the depicted embodiment, the slits 107 may be positioned and oriented at different angles (e.g. some slits substantially vertically oriented and other slits substantially horizontally oriented).

However, the above described embodiment is merely an example and other variations of the size and positioning of the slits may be employed without departing from the scope of this disclosure. For example, in other embodiments, the slits 107 do not have to be formed in both the upper portion 101A and second portion 101B. Instead, the slits 107 may be formed in only one of either the first portion 101A or the second portion 101B. Similarly, the positioning of the slits does not have to be confined to the perimeter of the footwear 101. The slits could be formed in other location also including the central portion of the footwear 100. In general, the slits 107 may be of varied length, spacing, orientation, positioning, etc. in order to create expansion and extension to match the size and shape of the a user's foot.

In addition to accommodating the shape of the foot, the slits 107 can provide ventilation, thereby cooling the foot and removing perspiration. The slits 107 provide a further advantage in that when they are in an expanded state they allow foreign matters to pass through the upper 101 and out of the footwear 100. For example, in contrast of a conventional upper, when the upper 101 is expanded state, the apertures will allow materials such as pebbles or sand to pass through and all out.

As shown in FIG. 1 according to some embodiments, the upper 101 includes a pull tab 109 and a vamp region 111 which are continuous and devoid of any of the plurality of slits 107. In such embodiments the pull tab 109 and vamp region 111 can provide more coverage to the user's foot. This would provide protection from such occurrences as sunburns, etc. which are more prone to occur on the tops of the feet. Further, the pull tab 109 can aid in putting on and removing the article of footwear 100 from the wearer's foot. For example, the wearer can grasp the pull tab 109 to pull it over the wearer's foot when the wearer is inserting their foot into the article of footwear 100. However, it is noted that other embodiments the vamp region 111 may contain one or more slits 107.

As discussed above, according to some embodiments of the disclosure, the article of footwear may include a sole structure 103. The sole structure 103 may be attached to the upper 101, in a conventional manner (e.g., using adhesives, stitching, welding, etc.). The sole structure 103 may be made of any materials commonly known in the art such as polymer foam material, rubber, etc. The sole structure 103 may be designed for specific purposes such as attenuating ground forces, providing traction, limiting weight of the footwear, providing durability, etc. For example, as shown in FIG. 5, the sole structure 103 may be comprised of a relatively thin layer of rubber which extends under the footbed and further contains a pattern of extended square elements 103A which include a raised circular portion. Such a sole structure 103 can aid in providing durability and attenuating ground forces, while allowing the footwear 100 to remain generally lightweight. Also, the sole structure 103 can aid in providing traction. Of course, other designs, features, elements, etc. of conventional sole structures could be employed in the alterative, or in addition to, the above described sole structure 103. Further, it is noted the article of footwear according to this disclosure, does not require a sole structure. In fact, according to other embodiments within the scope of the disclosure, no sole structure is attached. In such embodiments the lower portion 102B serves as the portion of the footwear which contacts the ground during use.

The above described configuration of the article of footwear which includes an upper 101 with first portion 101 A and a second portion 101 B; a seam 105 at the perimeter of the first and second portions and a plurality of slits 107 in the upper 101, results in several advantages including enhanced the collapsibility of the upper 101 footwear, reduction of volume in the collapsed state and the ability to easily conform to the user's foot.

Further, as described above, the article of footwear 100 requires only a few materials including a first plane of material, a second plane of material, material for joining the two planes of material and optionally a sole in order to be constructed. The relative limited amount of materials consumed by such construction of footwear achieves the afore mentioned object of limiting the amount of the materials used in manufacturing the footwear. Therefore, the article of footwear 100 can result in financial savings for the manufacturer and also reduce the environmental impact associated with the manufacturing the footwear.

As discussed above, the manufacturing process for the above disclosed embodiments includes constructing the footwear while it is in a collapsed, or flat, state. In other words, footwear according to aspects of the invention may be manufactured primarily by joining two flat planes of material and forming slits therein. Specifically, according to some embodiments of this disclosure, the process may include stamping and/or cutting the pieces of material that will form the first portion of the upper and the second portion of the upper; attaching the first portion of the upper and the second portion of the upper via stitching or some other conventional means; and attaching the upper to the sole via adhesive bonding or some other conventional means.

It can therefore be understood that the above described manufacturing process can reduce the time and energy associated with construction of the footwear. For example, the stitching around the periphery can be accomplished very quickly and easily as compared with conventional footwear that requires multiple separate and intricate stitching patterns over various parts of the footwear. Hence, footwear manufactured according to aspects of this disclosure can reduce the time and energy required to manufacture the footwear which will result in financial savings for the manufacturer. Further, the reduction in the amount of energy will also reduce the environmental impact associated with the manufacturing the footwear.

Figure 8:
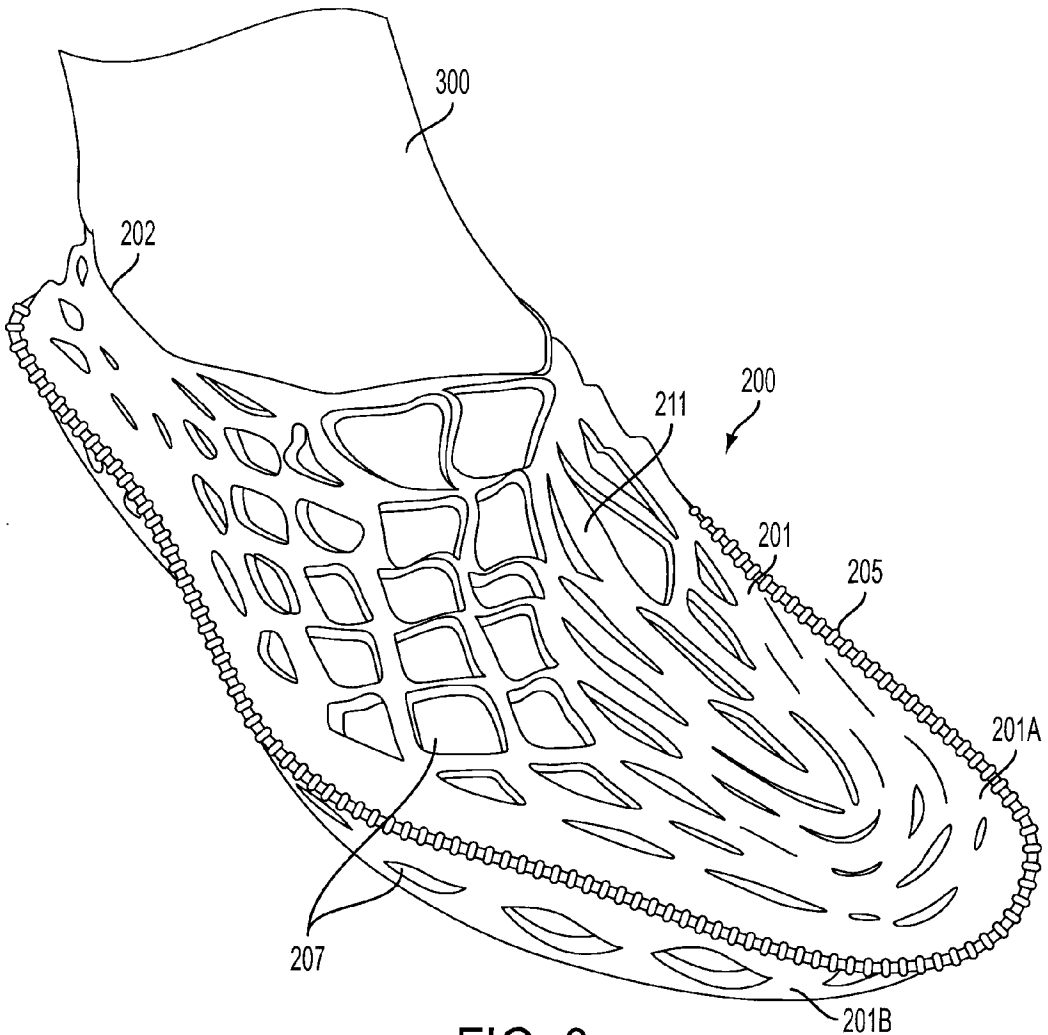
FIG. 8 illustrates a perspective view of an alternate embodiment of an article of footwear according to at least some other aspects of the disclosure with the article of footwear shown in a used state.
Figure 9:
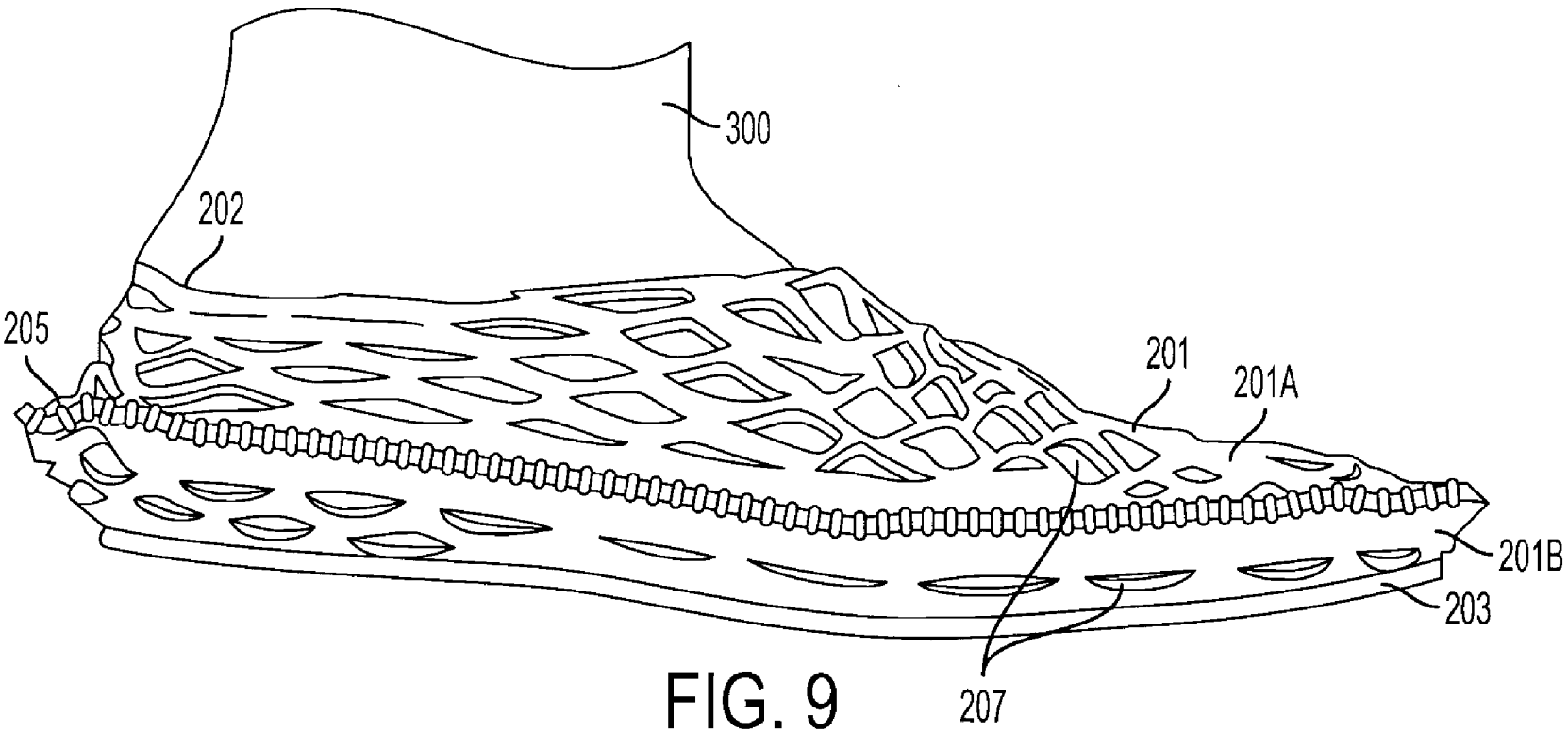
FIG. 9 illustrates a lateral view of the article of footwear shown in FIG. 8.

FIGS. 8 and 9 show views of another illustrative embodiment of an article of footwear according to other aspects of the invention. Similarly, to the first disclosed embodiment, the article of footwear 200 has a collapsible upper 201. However, this collapsible upper 201 does not include a pull tab 109. Instead, this collapsible upper 201 include a vamp region which extends towards the ankle and may include a plurality of slits 207 therein. Therefore, this collapsible upper 201 may surround the foot (especially the forefoot region) even more than already disclosed embodiment described above. Further, in contrast to the already disclosed embodiment described above, this collapsible upper 201 may provide additional slits 207 and, therefore, made provide more flexibility to conform to the user's foot and also provide additional ventilation. Much of the structure of this collapsible upper 201 has already been described with reference to the first disclosed embodiment and, therefore, specific discussion of it may be omitted for the sake of brevity.

Figure 10A:
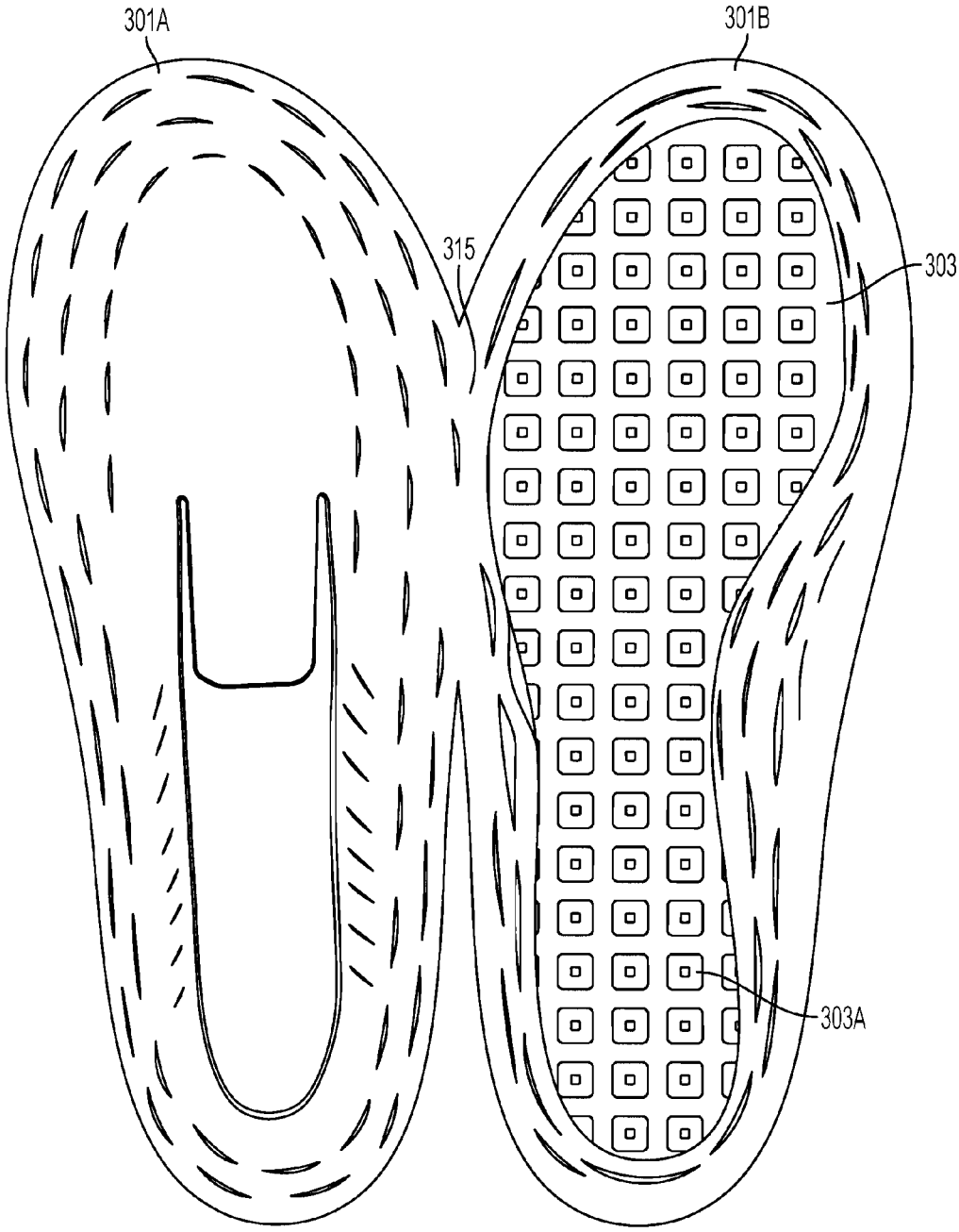
FIGS. 10A and 10B illustrate top views of an article of footwear according to at least some aspects of the disclosure
Figure 10B:
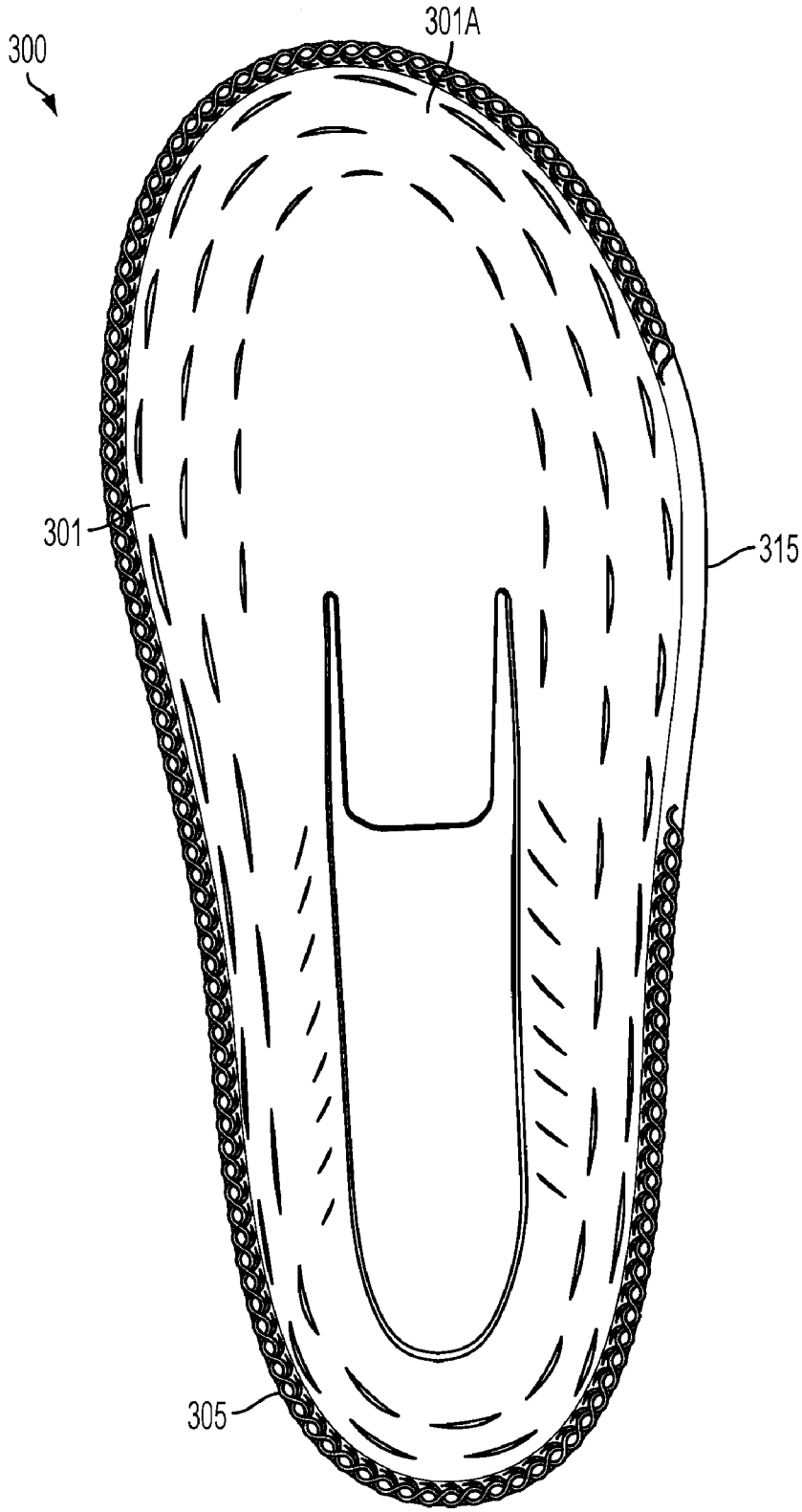

According to some aspects of the invention, the first portion of collapsible upper and the second portion of the collapsible upper may be created from a continuous piece of material which may be folded over and joined together to form the collapsible upper. FIGS. 10A and 10B show views of an illustrative embodiment of an article of footwear according to such aspects of the invention. Much of the structure of this article of footwear and collapsible upper has already been described with reference to the first disclosed embodiment and, therefore, specific discussion of it may be omitted for the sake of brevity.

Similarly, to the first disclosed embodiment, the article of footwear 300 has a collapsible upper 301. As seen in FIG. 10A, the collapsible upper 301 includes a first portion 301A and a second portion 301B. Further, as seen FIG. 10A, the first portion 301A and the second portion 301B are formed from a continuous piece of material. For example, as shown, the first portion 301A and the second portion 301B may be connected along their side regions.

As seen in FIG. 10B, the first portion of collapsible upper 301A may be folded over onto the second portion of the collapsible upper 301B so that the first portion 301A is on top of the second portion 301B. As seen in FIG. 10B, the first portion 301A and second portion 301B may have generally matching shapes and perimeters. Additionally, in such a collapsed state, the areas the first portion 301A and second portion 301B are generally similar. Further, as seen in FIG. 10B, the first portion of collapsible upper 301A and the second portion of the collapsible upper 301B may be joined together by a seam 305 to form the collapsible upper 301. For example, as seen in the illustrative embodiment, the seam 305 may join at least a portion of the perimeter of the first portion 301A with at least a portion of the perimeter of the second portion 301B. Of course, it is not necessary for the seam 305 to extend over the folded region 315 where the first portion of collapsible upper 301A and the second portion of the collapsible upper 301B are already joined together due to the fact that the first and second portions 301A and 301B are created from a continuous piece of material. For example, as shown in FIG. 10B, the seam 305 extends around a portion of the perimeter the collapsible upper 301 but does not extend into the folded region 315. In fact, as shown in FIG. 10B, when the article of footwear is in collapsed state, the seam 305 makes up a substantial portion of the perimeter of the footwear 300.

Of course it is noted that this is merely one embodiment of the invention and according to other aspects of the invention, the connection between the first portion 301A and the second portion 301B could have other characteristics. For example, the connection between the first portion 301A and the second portion 301B could be longer or shorter, positioned in a different location (e.g., another region of the first portion or second portion), perforated, etc.

According to some aspects of the invention, the collapsible upper may include an extended heel portion that extends upwards along the heel (and potentially the ankle) of the wearer when the collapsible upper is being worn on the wearer's foot. FIGS. 11-14 show views of an illustrative embodiment of an article of footwear according to such aspects of the invention. Much of the structure of this article of footwear and collapsible upper has already been described with reference to the first disclosed embodiment and, therefore, specific discussion of it may be omitted for the sake of brevity.

Figure 11:
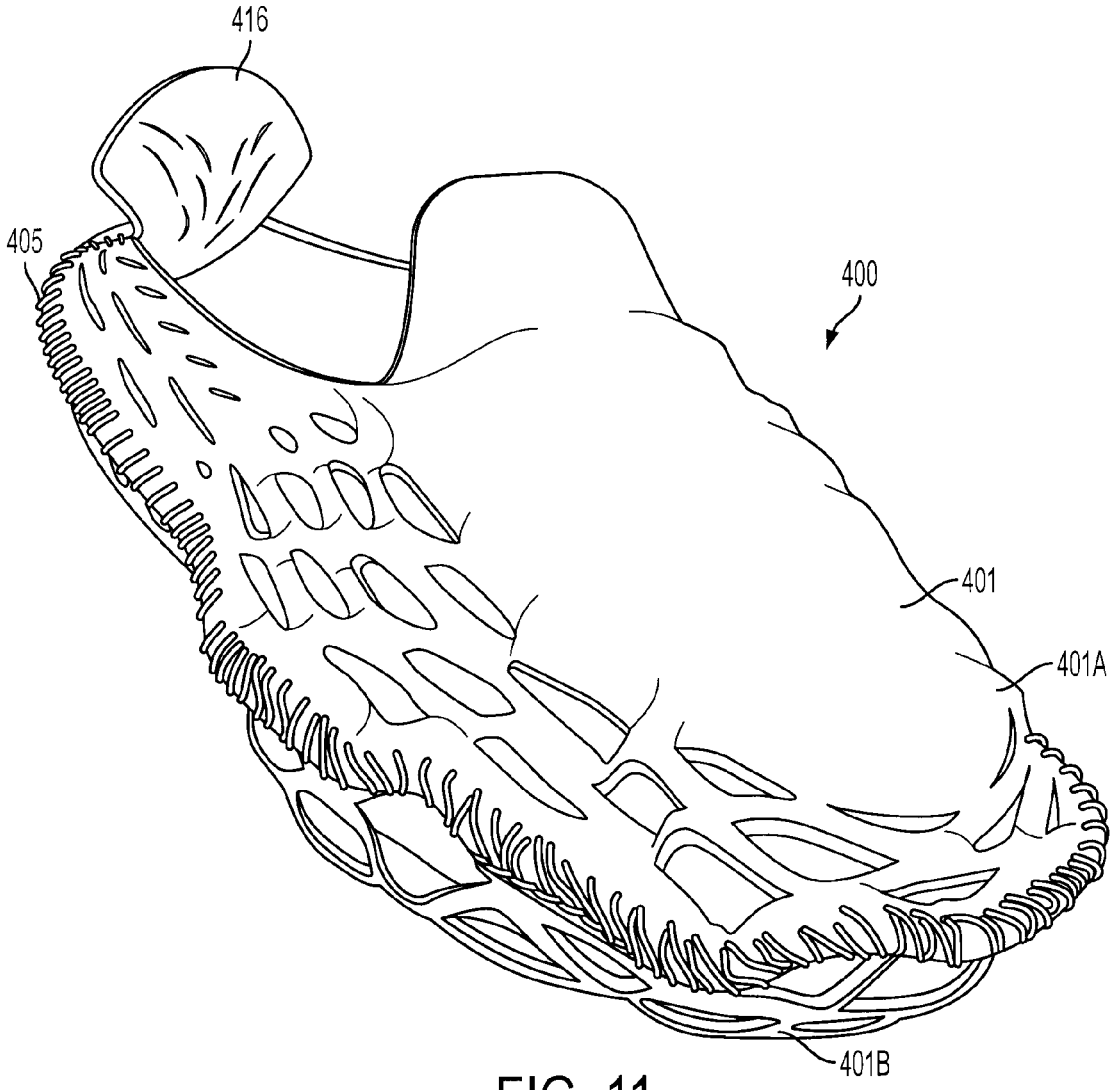
FIG. 11 illustrates a perspective view of an article of footwear according to at least some aspects of the disclosure with the article of footwear shown in a simulated use state
Figure 12:
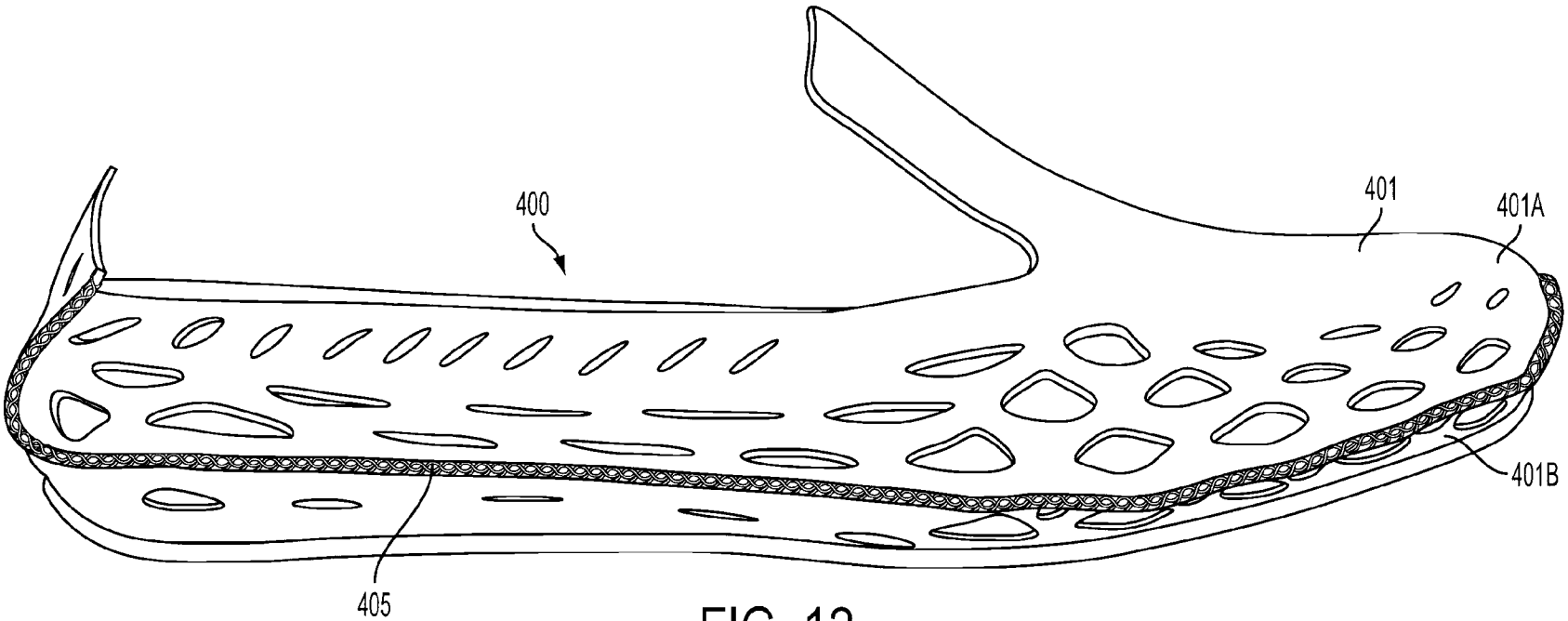
FIG. 12 illustrates a lateral side view of the article of footwear shown in FIG. 11.

FIG. 11 shows a perspective view of the article of footwear 400 in a simulated use state. FIG. 12 shows a side view of the article of footwear 400 in a simulated use state. Similarly, to the first disclosed embodiment, the article of footwear 400 has a collapsible upper 401 which includes a first portion 401A and a second portion 401B. Further, as seen in FIGS. 11 and 12, the collapsible upper 401 includes an extended heel portion 416. As seen in the depicted embodiment, the extended heel portion 416 may extend upward from and along the heel (and potentially the ankle) of the wearer when the article of footwear 400 is in a use state. In the depicted embodiment, the extended heel portion 416 is has a top portion that is generally crescent shaped and tapers slightly inwards towards the center of the extended heel portion 416. Such a shape allows the extended heel portion 416 to function a pull tab. Therefore, the extended heel portion 416 can aid in putting on and removing the article of footwear 400 from the wearer's foot. For example, the wearer can grasp the extended heel portion 416 to pull it over the wearer's heel when the wearer is inserting their foot into the article of footwear 400. Of course, it is noted that this is merely one embodiment and the extended heel portion 416 may be formed as any desired shape.

Figure 13:
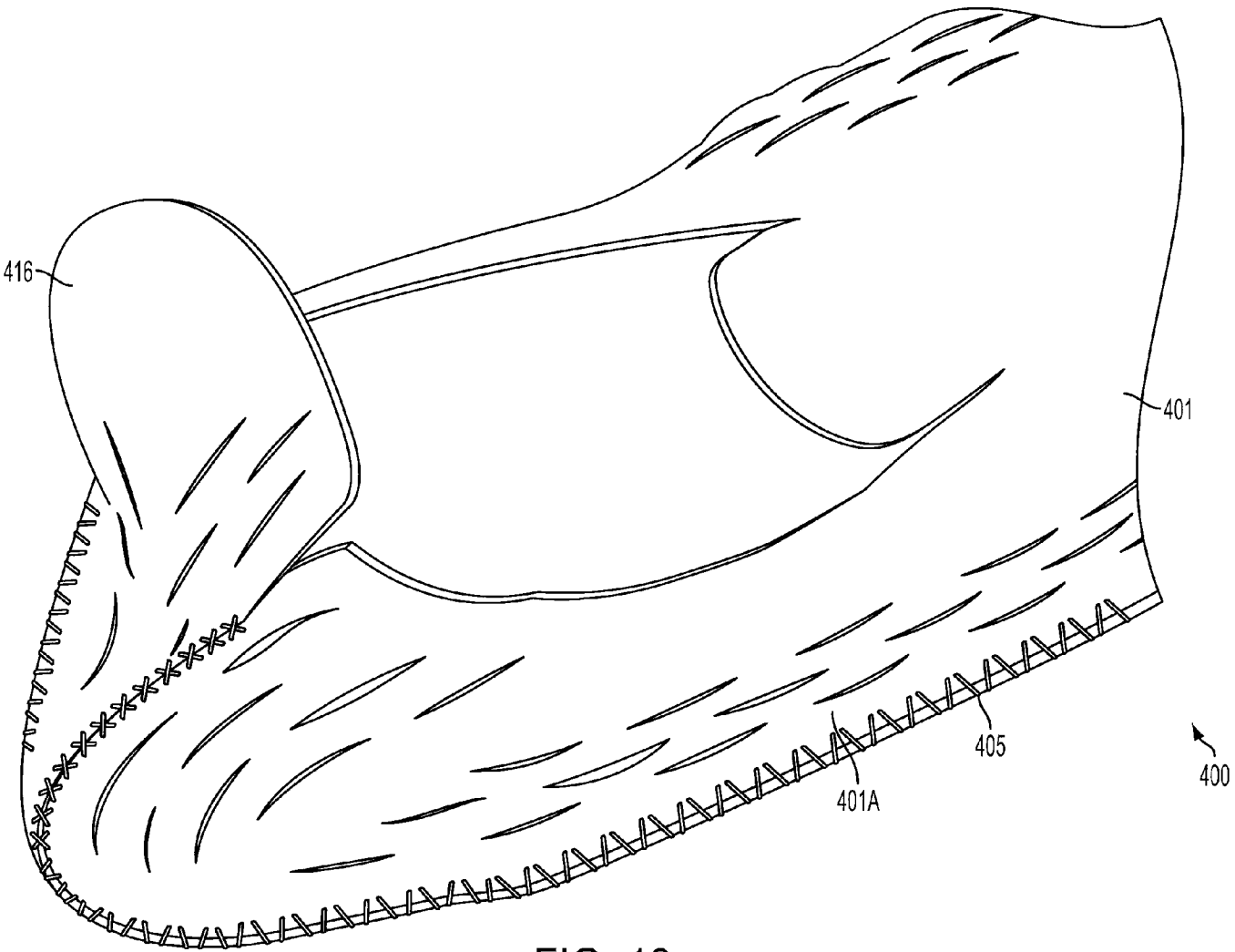
FIG. 13 illustrates a partial view of a heel region of an article of footwear according to at least some aspects of the disclosure with the extended heel portion shown in a simulated use state.

FIG. 13 shows a partial view of a heel region of illustrative embodiment of the invention with an extended heel portion shown in a simulated use state for illustrative purposes. As shown in FIG. 13, the extend heel portion 416 may be included in the first portion 401A. As seen in FIGS. 12 and 13, the heel portion of the collapsible upper 401 may be formed so that when the upper 401 is in an expanded state, the heel region drafts upwardly and inwardly towards the center of the article footwear 400 (i.e., towards the ankle of the user). Such a construction can provide a secure fit around the wearer's foot. Further, the extended heel portion 416 can provide an overall larger contact area between the collapsible upper 401 and the wearer's foot which will provide additional contact between the collapsible upper 401 and the wearer's foot and, therefore, aid in securing the collapsible upper 401 to the wearer's foot.

As seen in FIGS. 11 and 12, the first portion of collapsible upper 401A and the second portion of the collapsible upper 401B may be joined together by a seam 405. Further, as seen in FIG. 13, different sections of the first portion of collapsible upper 401A may also be joined together by the seam 405. For example, as shown in FIG. 13, different sections of the first portion of collapsible upper 401A are joined together in the heel region of the article of footwear by seam 405. As seen, at the heel region of the article of footwear 400, the seam 405 extends upwards from a perimeter of the collapsible upper 401 and along the heel region of the upper 401. An advantage of the above described configuration is that the seam 405 extends in such a manner to aid the extended heel portion 416 in drafting upwardly and inwardly towards the center of the article footwear 100 (i.e., towards the ankle of the user). This drafting allows the first and second portion to easily conform to the shape of the user's foot. Further, when the collapsible upper 401 is collapsed, this construction aids the extended heel region 401 to collapse inwardly towards the center of the article footwear 100 (i.e., in toward the ankle of the user).

Figure 14:
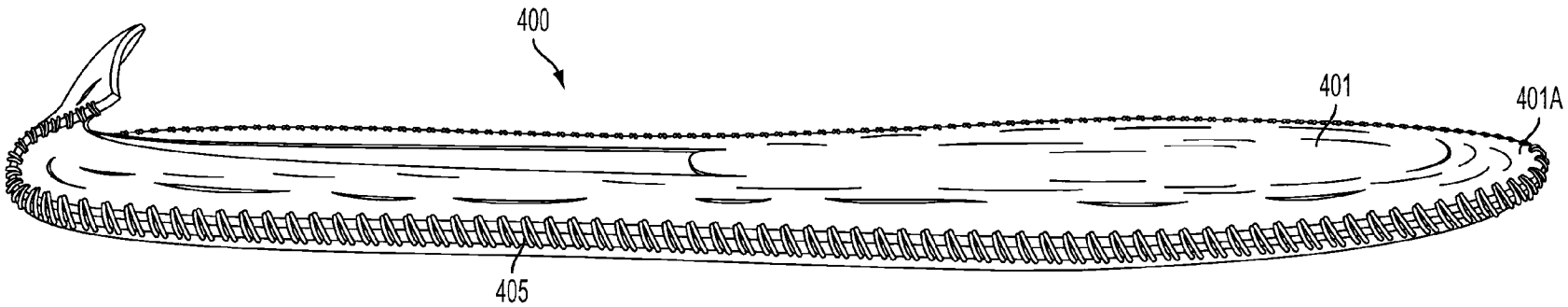
FIG. 14 illustrates a side perspective view of the article of footwear shown in FIG. 11 when the article of footwear is in a collapsed state.

FIG. 14 shows the collapsible upper 401 in a collapsed state. As seen in FIG. 14, the first portion 401A lies on the second portion 401B so that substantially all of a bottom surface of the first portion 101A is in contact with an upper surface of the second portion 101B. However, according to some aspects of the invention, depending on the construction of the collapsible upper 401 including the construction of the first portion of collapsible upper 401A and extended heel portion 416, the collapsible upper 401A and extended heel portion 416 may not lay completely flat on the upper surface of the second portion 101B at the heel region of the article of footwear 400. However, even in such embodiments, a majority of the bottom surface of the first portion 401A is still in contact with an upper surface of the second portion 401B. Further, regardless of which construction is employed, the first and second portions 401A and B are "stacked" on each other in such a manner that results in a collapsed state that will occupy a small amount of volume.

Figure 15:
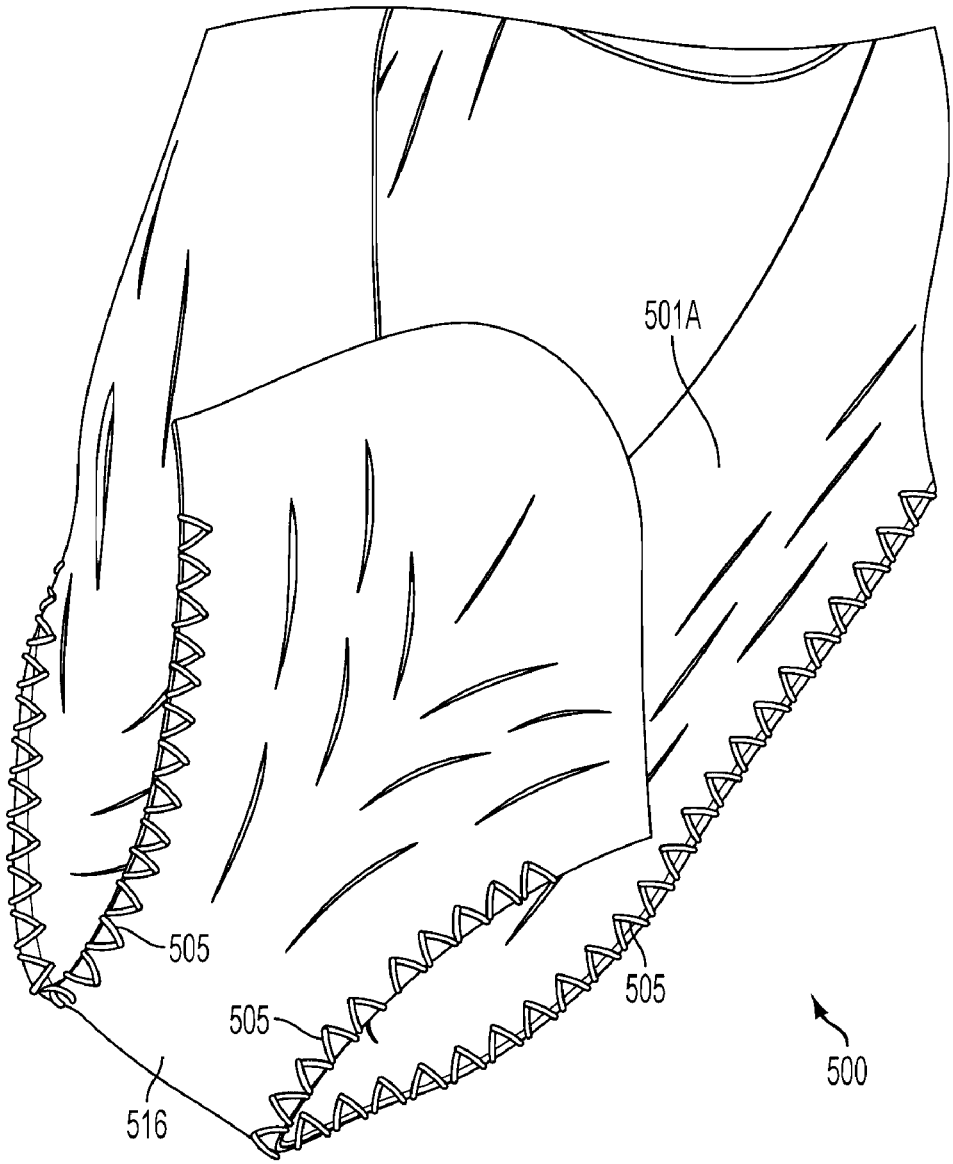
FIG. 15 illustrates a partial view of a heel region of an article of footwear according to at least some aspects of the disclosure when the article of footwear is in a collapsed state.
Figure 16:
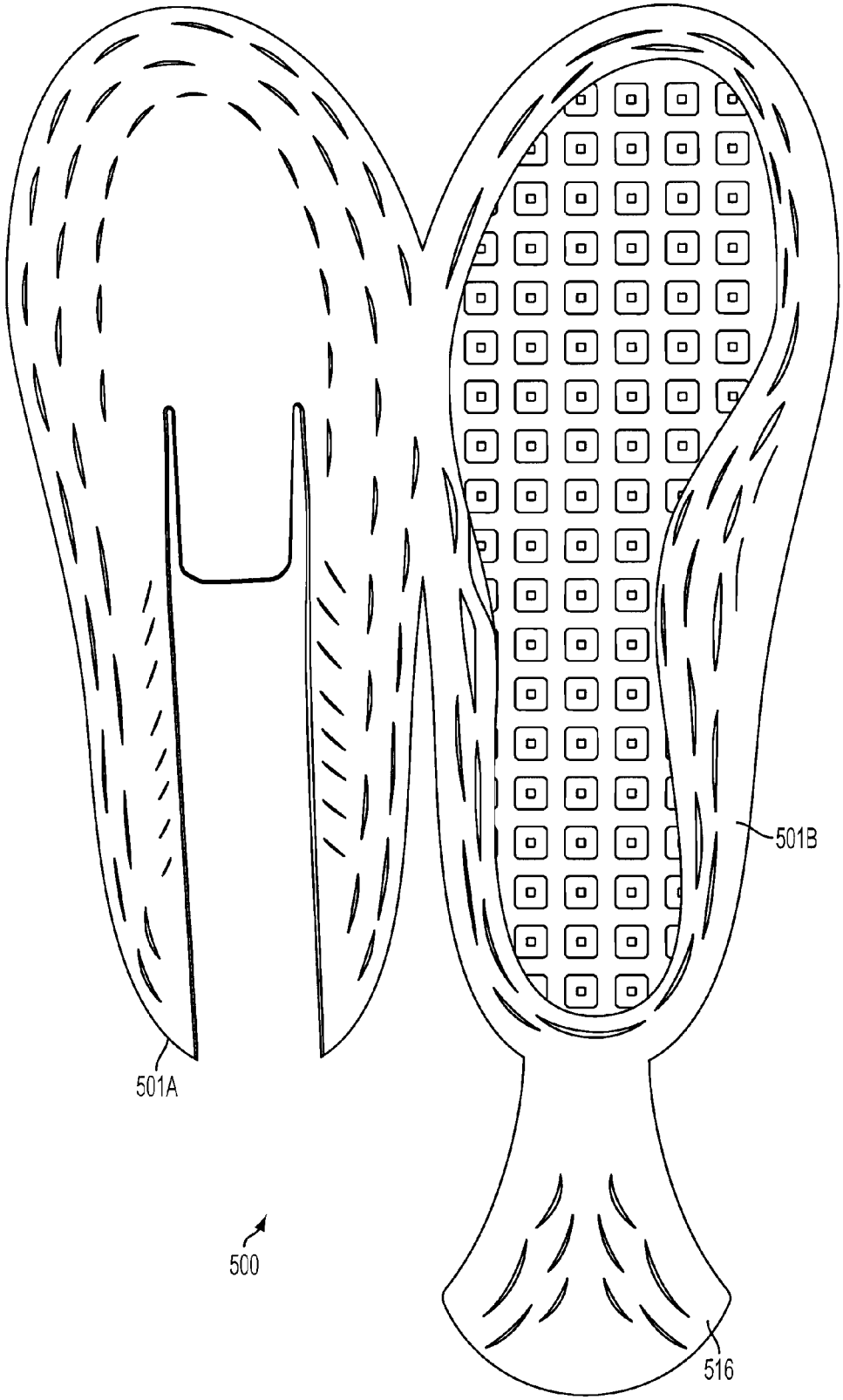
FIG. 16 illustrates a top view of the article of footwear shown in FIG. 15 when the article of footwear is in an unassembled state.
Figure 17:
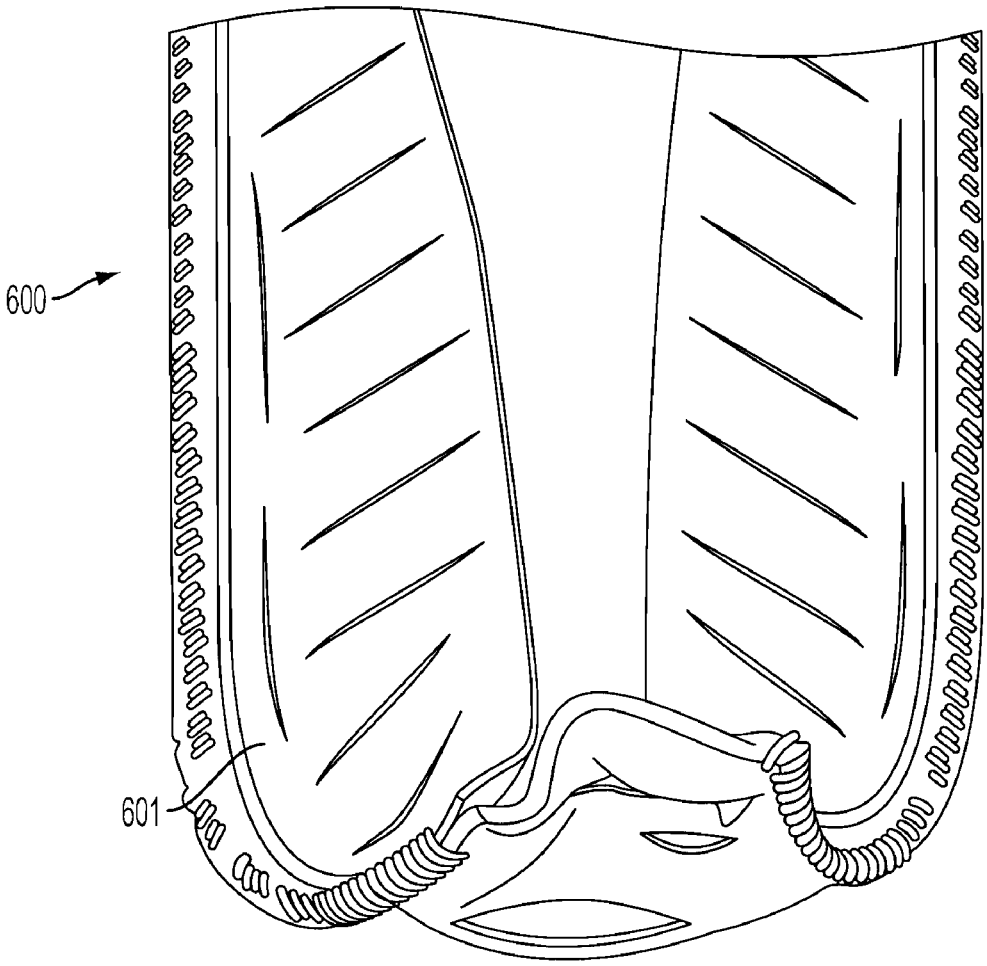
FIG. 17 illustrates a partial view of a heel region of an article of footwear according to at least some aspects of the disclosure when the article of footwear is in a collapsed state.

Of course it is noted that the above described illustrative embodiment is merely one embodiment of the invention and according to other aspects of the invention, the article of footwear including the heel region and the extended heel portion could have other characteristics. For example, FIGS. 15-17 show views of other illustrative embodiments of an article of footwear according to other aspects of the invention. Much of the structure of the articles of footwear and the respective collapsible uppers has already been described with reference to the above disclosed embodiment and, therefore, specific discussion of it may be omitted for the sake of brevity.

FIG. 15 shows a partial view of a heel region of illustrative embodiment of the invention with an extended heel portion shown in a collapsed state. FIG. 16 shows the article of footwear prior to assembly. As seen in FIG. 16, the article of footwear 500 has a collapsible upper 501 which includes a first portion 501A and a second portion 501B. As seen in FIG. 16, the first portion 501A and the second portion 510B are formed from a continuous piece of material (although it is noted that in other embodiments the first and second portions may be separate pieces of material). For example, as shown, the first portion 501A and the second portion 501B may be connected along their side regions. Further, the article of footwear 500 may include an extended heel portion 516. For example, as seen in FIG. 16, the extended heel portion 516 may be included in the second portion 501B.

Similarly to the above described embodiment, the first portion of collapsible upper 501A may be folded over onto the second portion of the collapsible upper 501B so that the first portion 501A is on top of the second portion 501B. Further, as seen in FIG. 15, the first portion of collapsible upper 501A and the second portion of the collapsible upper 501B may be joined together by a seam 505. Further, as seen in FIG. 15, the extended heel portion 516 may be joined to the first portion of collapsible upper 501A by seam 505. For example, as seen in the illustrative embodiment, the extended heel portion 516 may be folded over the first portion of the collapsible upper and may be joined to the first portion of collapsible upper 501A in the heel region of the article of footwear by seam 505 which extends on both a lateral and medial side of the extended heal portion 516. An advantage of the above described configuration is that the seam 505 extends in a manner at the heel region of the article of footwear 500 such that the seam 505 aids the extended heel portion 516 to draft upwardly and inwardly towards the center of the article footwear 500 (i.e., in towards the ankle of the user). For example, as seen in FIG. 15 when the collapsible upper 401 is collapsed, this construction aids the extended heel region 401 to collapse inwardly towards the center of the article footwear 100 (i.e., in towards the ankle of the user).

FIG. 17 shows a partial view of a heel region of illustrative embodiment of the invention with an extended heel portion shown in a collapsed state. FIG. 17 is similar to the embodiment shown in FIGS. 15 and 16, but for the shape of the extended heel portion 616. As shown in FIG. 16, the length of the extended heel portion is not as great as the length of the extended heel portion 515.

Of course, many modifications to the footwear structures and/or methods for making the footwear may be used without departing from the disclosure. For example, other structural elements may be provided and/or modified in the footwear structure without departing from the disclosure. Further, it is noted that the materials of the first portion and the second portion do not have to necessarily be the same material. For example, in embodiments described above which do not contain a sole structure, the lower portion of the upper may be made of a more durable material in order to serve as the portion of the shoe which contacts the ground.

While the disclosure has been described with respect to specific examples including presently preferred modes of carrying out the disclosure, those skilled in the art will appreciate that there are numerous variations and permutations of the above described structures and methods. Thus, the spirit and scope of the disclosure should be construed broadly as set forth in the appended claims.

I claim:

1. An article of footwear, comprising:

a sole;

a collapsible upper, wherein the sole is attached to the collapsible upper, the collapsible upper including:

a first portion;

a second portion which is below the first portion and extends from the sole to the first portion; and a seam which is positioned above the sole and is not in contact with the sole and further joins substantially the entire perimeter of the first portion with substantially the perimeter of the second portion;

wherein when the collapsible upper is in a collapsed state, the seam becomes the widest points of the article of footwear and defines the perimeter of the article of footwear, wherein the sole is surrounded by the second portion of the collapsible upper when the collapsible upper is in the collapsed state and when the collapsible upper is in an expanded state, and wherein when the collapsible upper is in the collapsed state, the first portion lies on the second portion so that substantially all of a bottom surface of the first portion is in contact with an upper surface of the second portion.

2. An article of footwear according to claim 1, wherein when the collapsible upper is in the collapsed state, the first portion of the collapsible upper is a substantially flat plane of material that extends in a first, substantially horizontal plane, and the second portion of the collapsible upper is a substantially flat plane of material that extends in a second, substantially horizontal plane underneath the first plane.

3. An article of footwear according to claim 1, wherein when the collapsible upper is in the collapsed state, the thickness or height of the collapsible upper is less than ½ inch.

4. An article of footwear according to claim 1, wherein when the collapsible upper is in the collapsed state, the thickness or height of the article of footwear is less than ¾ inch.

5. An article of footwear according to claim 1, wherein the collapsible upper includes a plurality of slits which allow the collapsible upper to expand to the expanded state to accommodate a foot of a user and when the collapsible upper is in the expanded state, the plurality of slits are expanded to create a plurality of apertures around a foot inserted into the footwear.

6. An article of footwear according to claim 1, wherein a plurality of slits formed in the collapsible upper include one or more slits formed in the first portion of the collapsible upper and one or more slits formed in the second portion of the collapsible upper.

7. An article of footwear according to claim 1, wherein when the collapsible upper is in the expanded state, the first portion of the collapsible upper drafts upwardly and inwardly from the seam towards the center of the article of footwear.

8. An article of footwear according to claim 7, wherein when the collapsible upper is in the expanded state, the second portion of the collapsible upper drafts downwardly and inwardly from the seam towards the center of the article of footwear.

9. An article of footwear according to claim 1, wherein when the collapsible upper is in the collapsed state the seam fully encircles the rest of the article of footwear.

10. An article of footwear comprising:

a sole; and a collapsible upper, wherein the collapsible upper includes a first portion;

a second portion which includes a central portion that defines a footbed which contacts and supports the sole portion of a user's foot when the foot is inserted into the article of footwear; and a seam, above the footbed, which joins the first portion and the second portion, wherein when the collapsible upper is in a collapsed state, the seam defines the article of footwear's widest point and further the seam extends around the perimeter of the article so as to encircle the footbed, wherein the sole is surrounded by the second portion of the collapsible upper when the collapsible upper is in the collapsed state and when the collapsible upper is in an expanded state, and wherein when the collapsible upper is in the collapsed state, the first portion lies on the second portion so that substantially all of a bottom surface of the first portion is in contact with an upper surface of the second portion.

11. An article of footwear according to claim 10, wherein when the collapsible upper is in the collapsed state, the collapsible upper is a substantially flat plane that extends in a substantially horizontal plane relative to the footbed.

12. An article of footwear according to claim 10, wherein when the collapsible upper is in the collapsed state, the thickness or height of the collapsible upper is less than ½ inch.

13. An article of footwear according to claim 10, wherein when the collapsible upper is in the collapsed state, the thickness or height of the article of footwear is less than ¾ inch.

14. An article of footwear according to claim 10, wherein the collapsible upper includes a plurality of slits which allow the collapsible upper to expand to the expanded state to accommodate a foot of a user and when the collapsible upper is in the expanded state, the plurality of slits are expanded to create a plurality of apertures around the foot inserted into the footwear.

15. An article of footwear, comprising:

a sole; and a collapsible upper comprising:

a first portion, a second portion, which is below the first portion and extends from the sole to the first portion;

a seam which is positioned above the sole and is not in contact with the sole and further joins at least a portion of the perimeter of the first portion with at least a portion of the perimeter of the second portion;

wherein when the collapsible upper is in a collapsed state, the seam becomes the widest points of the article of footwear and defines at least a portion of the perimeter of the article of footwear, wherein the sole is surrounded by the second portion of the collapsible upper when the collapsible upper is in the collapsed state and when the collapsible upper is in an expanded state, and when the collapsible upper is in the collapsed state, the first portion lies on the second portion so that substantially all of a bottom surface of the first portion is in contact with an upper surface of the second portion.

16. An article of footwear according to claim 15, wherein the seam joins at least substantially the entire perimeter of the first portion with at least substantially the entire perimeter of the second portion;

further wherein the seam extends at least substantially around the perimeter of the collapsible upper and fully encircles the rest of the article of footwear.

17. An article of footwear according to claim 15, wherein when the collapsible upper is in the collapsed state, the thickness of the collapsible upper is less than ¼ inch.

18. An article of footwear according to claim 15, wherein when the collapsible upper is in the collapsed state, the first portion of the collapsible upper is a substantially flat plane of material that extends in a first, substantially horizontal plane, and the second portion of the collapsible upper is a substantially flat plane of material that extends in a second, substantially horizontal plane underneath the first plane.

19. An article of footwear according to claim 15, wherein the collapsible upper includes a plurality of slits which allow the collapsible upper to expand to the expanded state to accommodate a foot of a user and when the collapsible upper is in the expanded state, the plurality of slits are expanded to create a plurality of apertures around the foot inserted into the footwear.

* * * * *